US011391183B2

(12) United States Patent
Jin

(10) Patent No.: US 11,391,183 B2
(45) Date of Patent: Jul. 19, 2022

(54) ORC POWER GENERATION APPARATUS

(71) Applicant: Jung-Hong Jin, Busan (KR)

(72) Inventor: Jung-Hong Jin, Busan (KR)

( * ) Notice: Subject to any disclaimer, the term of this patent is extended or adjusted under 35 U.S.C. 154(b) by 0 days.

(21) Appl. No.: 17/040,673

(22) PCT Filed: Apr. 8, 2019

(86) PCT No.: PCT/KR2019/004118
§ 371 (c)(1),
(2) Date: Sep. 23, 2020

(87) PCT Pub. No.: WO2020/009314
PCT Pub. Date: Jan. 9, 2020

(65) Prior Publication Data

US 2021/0025293 A1 Jan. 28, 2021

(30) Foreign Application Priority Data

Jul. 6, 2018 (KR) ..... 10-2018-0079320

(51) Int. Cl.
*F01K 11/02* (2006.01)
*F01K 25/08* (2006.01)
(Continued)

(52) U.S. Cl.
CPC ..... *F01K 11/02* (2013.01); *F01D 25/145* (2013.01); *F01K 25/08* (2013.01); *F25B 1/00* (2013.01);
(Continued)

(58) Field of Classification Search
CPC ..... F01K 11/00; F01K 11/02; F01K 9/003; F01K 7/16; F01K 25/08; F01K 25/10;
(Continued)

(56) References Cited

U.S. PATENT DOCUMENTS 3,857,244 A * 12/1974 Faucette ..... F03G 7/04 60/641.2
2007/0056288 A1* 3/2007 Schoell ..... F01K 11/00 60/670
(Continued)

FOREIGN PATENT DOCUMENTS

KR 20050093002 9/2005
KR 20150139309 12/2015
KR 20160022461 3/2016

*Primary Examiner* — Mark A Laurenzi
*Assistant Examiner* — Xiaoting Hu
(74) *Attorney, Agent, or Firm* — IPLA P.A.

(57) ABSTRACT

An ORC power generation apparatus for generating power by using new renewable thermal energy, includes: a housing, which has a front cover with a fluid inlet and a rear cover with a fluid outlet and is provided as structure insulated and sealed off from external air; a plurality of turbines which use an organic compound as a working fluid and having turbine shafts, each of which has one end portion penetrating a bored hole and a bearing provided in the center of the front cover of the housing so as to protrude outward, and has the other end portion coupled to a bearing provided in the center of the rear cover of the housing; and heat suppliers provided inside the housing and provided at the front of a working fluid inlet hole of each of the plurality of turbines.

15 Claims, 3 Drawing Sheets

(51) Int. Cl.

| | |
|---|---|
| ***F25B 1/00*** | (2006.01) |
| ***F01D 25/14*** | (2006.01) |
| ***F01K 7/16*** | (2006.01) |
| ***F01K 9/00*** | (2006.01) |

(52) U.S. Cl.
CPC ..... *F01K 7/16* (2013.01); *F01K 9/003* (2013.01); *F05D 2220/30* (2013.01)

(58) Field of Classification Search
CPC ..... F25B 1/00; F01D 25/14; F01D 25/145; F01D 25/24
See application file for complete search history.

(56) References Cited

U.S. PATENT DOCUMENTS

| | | | | |
|---|---|---|---|---|
| 2016/0265390 | A1* | 9/2016 | Burg | F01K 9/003 |
| 2016/0319703 | A1* | 11/2016 | Burg | F01D 25/10 |
| 2019/0292928 | A1* | 9/2019 | Nogami | F01D 19/00 |

* cited by examiner

ORC POWER GENERATION APPARATUS

BACKGROUND

The present invention relates to a power generation apparatus that is available to an organic Rankine cycle (ORC) power generation system using new renewable energy and, more particularly, to an ORC power generation apparatus that is capable of improving power generation efficiency and providing compact installation, in an ORC cycle wherein a working fluid is gasified and heated at a relatively low temperature range having a maximum temperature of about 100 to 150° C., generates rotary power with a pressure produced therefrom, and is thus liquefied and circulated at a temperature range having a minimum temperature of −40° C., thereby reducing manufacturing and installation costs to ensure fast commercialization.

BACKGROUND ART

Referring first to a conventional "organic Rankine cycle power generation system having re-heating means" (which is disclosed in Korean Patent Application Laid-open No. 10-2018-0091613) as filed by the same applicant as in the invention, before the description of this invention, the conventional organic Rankine cycle power generation system, which uses a working fluid gasified and high-pressurized at a low temperature heat source, receives additional thermal energy from the re-heating means located on an outer casing of an engine, in a process where the working fluid enters the engine to generate power, thereby increasing the power generation efficiency of the engine.

Only through the addition of the re-heating means to the engine, however, the power generation efficiency cannot be sufficiently improved, and also, the conventional ORC power generation system fails to satisfy economical installation.

According to characteristics of new renewable energy, the thermal energy supplied is low in density and is distributed over a large area, and above all, an ORC power generation apparatus has to ensure economical installation in converting the thermal energy collected from a heat source scattered in the large area into power energy.

Other conventional power generation apparatuses have been disclosed in Korean Patent Application Laid-open No. 10-2005-0093002 entitled "Axial flow multistage turbine", Korean Patent Application Laid-open No. 10-2015-0139309 entitled "Through hole type centrifugal multistage turbine", and Korean Patent Application Laid-open No. 10-2016-0022461 entitled "Through hole type centrifugal multistage turbine", and some of the conventional apparatuses have been already produced and prevailed. However, their power generation efficiency is low to cause a high power generation cost, so that they still fail to be commercialized.

SUMMARY OF THE INVENTION

As mentioned above, it is absolutely necessary in the art to provide an ORC power generation system capable of ensuring high power generation efficiency, providing a low power generation system cost to ensure good economical effects, and lowering a power generation cost, as soon as possible.

Accordingly, the present invention has been made in view of the above-mentioned problems occurring in the related art, and it is an object of the present invention to provide an ORC power generation apparatus that is capable of allowing various parts to be combinedly coupled to each other, thereby increasing power generation efficiency, simplifying manufacturing and installation processes, and lowering production and installation costs.

Technical Solution

To accomplish the above objects, there is provided an ORC power generation apparatus as will be discussed later, and in this case, turbines used in the ORC power generation apparatus according to the present invention include turbines for closed ORC developed and used at present and disc turbines for an ORC suggested in the present invention. Of course, the turbines may include turbines for an ORC to be developed in the future.

According to the present invention, firstly, a plurality of turbines for the ORC as mentioned above are located, while their turbine shafts being connected in series to each other, and further, heat suppliers used as superheaters and a reheater are located in front of each turbine in a single housing, thereby improving power generation efficiency and simplifying installation structure.

Secondly, the ORC power generation apparatus according to the present invention suggests the disc turbines for the ORC capable of expecting upgraded efficiency, instead of the existing turbines for the ORC.

Thirdly, the ORC power generation apparatus according to the present invention is configured to have the turbines located in parallel to each other in the same housing as each other, each turbine having a working fluid inlet hole formed on one side surface thereof and a working fluid outlet hole formed on the other side surface thereof, and to have heat suppliers as superheaters and a reheater located in front of the working fluid holes of the turbines, thereby improving power generation efficiency and simplifying installation structure.

Fourthly, the ORC power generation apparatus according to the present invention is configured to allow heat suppliers and turbines to be located in a single housing and to further allow a fluid liquefier to be located inside the single housing, so that the working fluid which finishes power generation is liquefied in the same housing to prevent the occurrence of pressure loss by the bottleneck generated when the working fluid passes through a narrow pipe, thereby enhancing power generation efficiency and ensuring more compact installation.

Lastly, the ORC power generation apparatus according to the present invention is configured to have a plurality of turbines and a fluid liquefier combindedly located in the same signal housing, thereby providing a compact size appropriate to a place where a relatively high temperature heat source is produced and an installation area is limited.

Advantageous Effects

According to the present invention, the ORC power generation apparatus is configured to allow a working fluid (hereinafter, referred to as "fluid") preheated at the outside to come into contact with the turbines located inside the housing having the fluid inlet and with the heat suppliers located in front of the working fluid inlet holes of the turbines and to be thus super-heated, so that the fluid enters the turbines through the inlet holes of the turbines, thereby enhancing power generation efficiency, and as the heat suppliers and the turbines are repeatedly located inside the same housing, the fluid passing through the heat suppliers and the turbines can generate power additionally and repeatedly when passes through the rear side heat supplier and the rear side turbine. Also, the fluid which finishes the power generation is liquefied in the fluid liquefier located at the rear side of the housing, thereby simplifying the structure and easily performing the coupling, and accordingly, the ORC power generation apparatus according to the present invention can be installed even by users who have poor skills in the art, without any troubles, thereby achieving reduction in all of production cost, installation space, and installation cost.

In addition, the ORC power generation apparatus according to the present invention is configured to have the parts for generating power for the ORC to be repeatedly mounted inside the single housing, thereby increasing power generation efficiency, simplifying manufacturing and installation processes, reducing production and installation costs, and suggesting the turbines with high power generation efficiency to achieve many economical advantages.

DETAILED DESCRIPTION OF THE INVENTION

Figure 1:
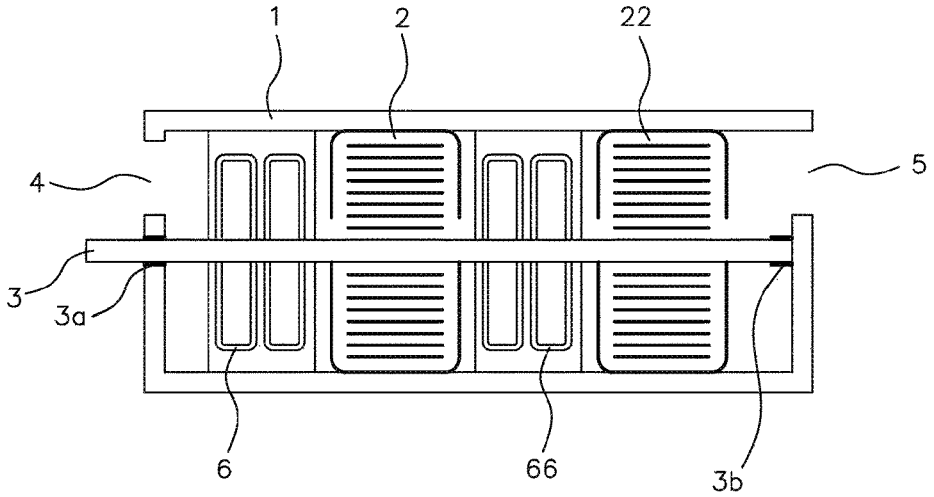
FIG. 1 shows a configuration of an ORC power generation apparatus according to a first embodiment of the present invention, wherein serial connected turbines for ORC and heat suppliers are provided.

Kinds of ORC power generation apparatuses according to various embodiments of the present invention can be differently selected in accordance with conditions given to carry out the present invention, such as a temperature of a heat source, an installation place, and so on.

The ORC power generation apparatuses according to the present invention include closed fluid turbines developed and used at present, closed fluid turbines to be developed in the future, and fluid turbines suggested newly in the present invention so as to improve power generation efficiency, and each ORC power generation apparatus is characterized in that heat suppliers are located in front of one or more turbines disposed inside a housing so as to increase a pressure of a fluid in the housing and thus to generate power, and further, a fluid liquefier for liquefying a fluid which finishes power generation is combinedly located inside the single housing.

A general term 'turbine' indicates a combined unit of a turbine casing, a turbine shaft, and power generating means (hereinafter, referred to as 'power means'), and the housing as mentioned in the present invention serves as a casing of the fluid liquefier as well as a casing for the heat suppliers. Furthermore, the housing serves as a casing for the turbines.

Accordingly, the housing as mentioned above is used for multiple purposes, and for the obviousness of the description, the housing will be explained as an independent part from the components of the turbine. Accordingly, the term 'turbine' used in the present invention is limited as the combined part of the power means and the turbine shaft. Further, the casings of the existing developed turbines generally serve as supports and outer shells for supporting the power means and the turbine shafts and also serve as fluid paths through which a fluid moves, fluid injection holes, and fluid discharge holes. In this case, the turbine casings can be considered as parts for the power means. Under the consideration, the preset invention will be explained below.

Moreover, the term 'fluid' used in the present invention indicates a fluid for working the turbines, which is also described as 'working fluid', and in the present invention, in this case, the fluid and the working fluid are the same as each other.

Before the detailed description of the present invention, further, necessary parts that are required for operation among all parts, as will be understood to those skilled in the art, will be not explained in the embodiments of the present invention as will be discussed later.

If it is determined that the detailed explanation on the well known technology related to the present invention makes the scope of the present invention not clear, the explanation will be avoided for the brevity of the description.

Further, the terms as will be discussed later are defined in accordance with the functions of the present invention, but may be varied under the intention or regulation of a user or operator. Therefore, they should be defined on the basis of the whole scope of the present invention.

Hereinafter, the present invention will now be described in detail with reference to the attached drawing.

First Embodiment

As shown in FIG. 1, an ORC power generation apparatus according to a first embodiment of the present invention includes turbines, among closed fluid turbines developed and used at present and closed fluid turbines to be developed in the future, each turbine having a turbine shaft whose advancing direction corresponding to an advancing direction of a fluid, so that a working fluid inlet hole is formed on a front surface of each turbine, from which a turbine shaft protrudes, and the working fluid which finishes its operation is discharged to a rear surface of each turbine, and heat suppliers as superheaters located in front of the turbines.

First, the ORC power generation apparatus according to the first embodiment of the present invention includes a housing 1 provided as an insulated and sealed structure and having a front cover with a fluid inlet 4 formed thereon and a rear cover with a fluid outlet 5 formed thereon.

Desirably, the housing 1 whose interior is cylindrical, and an external casing in which the cylindrical housing 1 is built has a shape of a rectangular parallelepiped. However, of course, only the cylindrical housing 1 may be provided, without the external casing.

The housing 1 is separable into two or more portions, and connection flanges (not shown) are desirably provided on the separated cut surfaces so as to easily couple the separated cut surfaces by means of bolts. All of the housings 1 adopted in the embodiments of the present invention as will be discussed later may be also separable and provided with the connection flanges, and explanations on such characteristics of the housings 1 will be not given below.

The front cover of the housing 1 has a bored hole formed on the center thereof and a bearing 3*a* inserted into the bored hole. Further, the rear cover of the housing 1 has a bearing 3*b* located on the center thereof. One end portion of a turbine shaft 3 is extended inside the housing 1 in such a manner as to pass through the bearing 3*a* of the front cover of the housing 1 and thus protrude outward, and the other end portion of the turbine shaft 3 is extended and fitted to the bearing 3*b* of the rear cover of the housing 1.

As a fluid moves from the front cover side of the turbine shaft 3 to the rear cover side thereof, power is generated, and a plurality of turbines 2 using an organic compound as a working fluid are provided with their turbine shafts 3 connected in series to each other.

Connected portions of the turbine shafts 3 connected in series to each other are provided with power connection means like universal joints, couplings, and so on. In the embodiments of the present invention as will be discussed later, the above-mentioned power connection means may be fastened to connected portions of the turbine shafts 3 connected in series to each other, and accordingly, an explanation on such fastening will be not given below.

Desirably, a high pressure pump (not shown) is fitted to the fluid inlet 4 to put the fluid into the housing 1.

A load is applied to one side end of the turbine shaft 3 passing through the bored hole of the front cover and thus protruding outward, and power generated from the applied load is used directly or for power generation.

Heat suppliers 6, which serve as superheaters for the fluid, are located in front of the turbines 2 inside the housing 1 in such a manner as to allow the turbine shafts 3 to pass through centers thereof.

As the heat suppliers 6 serving as the superheaters are located in front of the turbines 2 inside the housing 1, like this, the pre-heated fluid flowing into the housing 1 comes into contact with the heat suppliers 6 inside the housing 1 and is thus super-heated, so that the super-heated fluid becomes a high temperature and high pressure fluid and thus enters the turbines 2, thereby generating power with higher efficiency. Next, the fluid passing through the turbines 2 receives thermal energy from the rear side heat supplier 66, in addition to the residual thermal energy retained, and is thus somewhat raised in temperature and pressure, so that it enters the rear side turbine 22 to additionally generate the power.

Like this, the fluid entering the housing 1 moves along the interior of the housing 1 and passes through the heat suppliers 6 and the turbines 2, and in this case, the fluid does not flow along a separate fluid pipe located inside the housing 1 so as to perform heat exchange with the heat suppliers 6 through the fluid pipe. According to the present invention, in detail, the fluid moves along the housing 1 and comes into direct contact with the heat suppliers 6 to thus perform heat exchange with the heat suppliers 6, so that all surfaces of the heat suppliers 6 come into direct contact with the fluid, thereby achieving rapid heat exchange and avoiding a pressure loss which is generated when the fluid flows along the fluid pipe.

Figure 6:
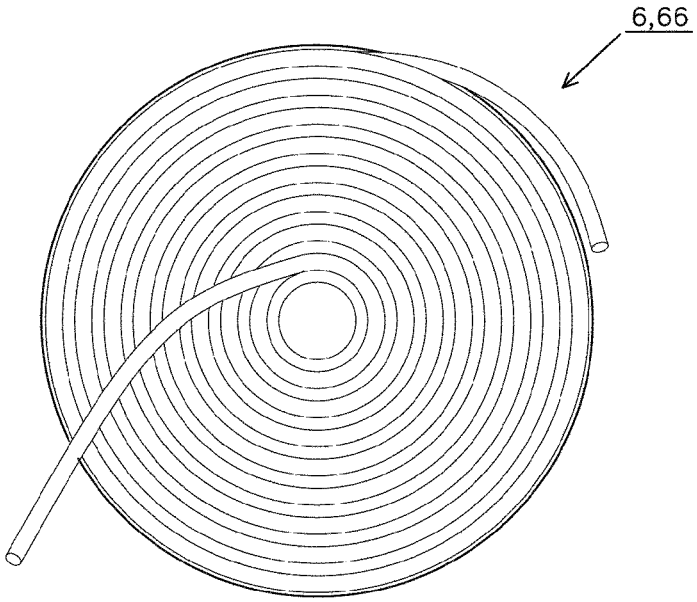
FIG. 6 shows a front view of the heat supplier according to the present invention.

The heat suppliers 6 and 66 serving as the superheaters and the re-heater have shapes of water jackets in such a manner as to allow the fluid to pass therethrough, but as shown in FIG. 6, each heat supplier includes a band fastenable to an inner peripheral wall of the housing 1 and a pipe having a shape of a circular coil located inside the band to allow the fluid to flow therealong. Also, the turbine shaft 3 is desirably fitted to the center of the band.

Further, the thermal energy supplied to the heat suppliers 6 serving as the superheaters is selected from a heat source with the highest temperature among the heat sources available, and through the fluid whose temperature is a little lowered after passing through the heat suppliers 6 or through the fluid obtaining the thermal energy from the heat source lowered by one step, the thermal energy is desirably supplied to the rear side heat supplier 66 serving as the re-heater.

Furthermore, if the turbine casings coupled to the turbines 2 serve as the fluid paths through which the fluid passes or serve as the working fluid inlets and the working fluid outlets of the turbines 2, the external casing functions as one necessary part of the power means of the turbines 2, and accordingly, the external casing is coupled to the turbine casings and is thus located inside the housing 1. However, if the turbine casings just serve as the external walls of the parts of the turbines 2 or as supports of the turbine shafts 3, the housing 1 can act for the turbine casings, and after the turbine casings are removed, accordingly, the power means as the internal parts of the turbines 2 is desirably coupled to the interior of the housing 1.

As shown in FIG. 1, the ORC power generation apparatus under the above-mentioned configuration allows the working fluid to be first pre-heated with the heat source from which new renewable energy is generated and to be thus introduced into the housing 1 by means of a high pressure pump (not shown). Next, the working fluid passes through the heat suppliers 6 serving as the superheaters and thus has high temperature and high pressure, and sequentially, the working fluid is injected into the turbines 2 to generate power. After that, the working fluid is discharged to the outsides of the turbines 2 and is re-heated through the rear side heat supplier 66, so that it is injected into the rear side turbine 22 to allow the residual thermal energy to be converted into rotary power. Next, the working fluid is discharged to the outside of the housing 1, condensedly liquefied in a liquefier, and is recycled as a heat source.

So as to achieve manufacturing conveniences and reduction in manufacturing cost, also, all or some of the parts of the turbines 1, excepting the fastening parts like bolts and nuts and lubrication parts like bearings, are desirably made of high-strength plastic materials, and accordingly, the above-mentioned conditions are applied to the turbines 2 adopted in the various embodiments of the present invention.

As described above, the ORC power generation apparatus according to the first embodiment of the present invention is configured to have the heat suppliers 6 and the turbines 2 repeatedly arranged inside the housing 1, thereby generating power with higher efficiency in converting the new renewable energy having a low temperature into power energy.

Second Embodiment

Instead of the existing turbines 2 adopted in the first embodiment of the present invention, an ORC power generation apparatus according to a second embodiment of the present invention includes turbines newly suggested in the present invention and heat suppliers 6 located in front of each turbine, and the ORC power generation apparatus according to the second embodiment of the present invention will be explained with reference to FIG. 2.

So as to more obviously explain the turbines suggested in the second embodiment of the present invention and to thus distinguish them from the exiting turbines 2, the parts constituting the turbines are divided into turbine shafts 3 and power means 100, and the turbines are called combined bodies of the turbine shafts 3 and the power means 100.

The housing 1, the turbine shafts 3, and the heat suppliers 6, which are provided, excepting the power means 100 suggested in the second embodiment of the present invention, have the same configurations and functions as in the first embodiment of the present invention.

The power means 100 provided as one unit part, which is built in the housing 1, includes an inlet plate 110, a rotor 120, a stator 130, a rotor 120, and an outlet plate 150 sequentially located from the inner front side of the housing 1 at which the fluid inlet 4 is formed toward the rear surface of the housing 1 at which the fluid outlet is formed and further includes a lubricating oil supplier 160.

Moreover, the lubricating oil supplier 160 located on the underside of the power means 100 is provided with an oil supply pump (not shown) to allow the rotors 120 to smoothly slide and rotate between the inlet plate 110 and the stator 130 and between the stator 130 and the outlet plate 150.

The inlet plate 110, the rotors 120, the stator 130, and the outlet plate 150 have through holes serving as fluid paths.

Like this, the plurality of power means 100 are located inside the housing 1.

Figure 2:
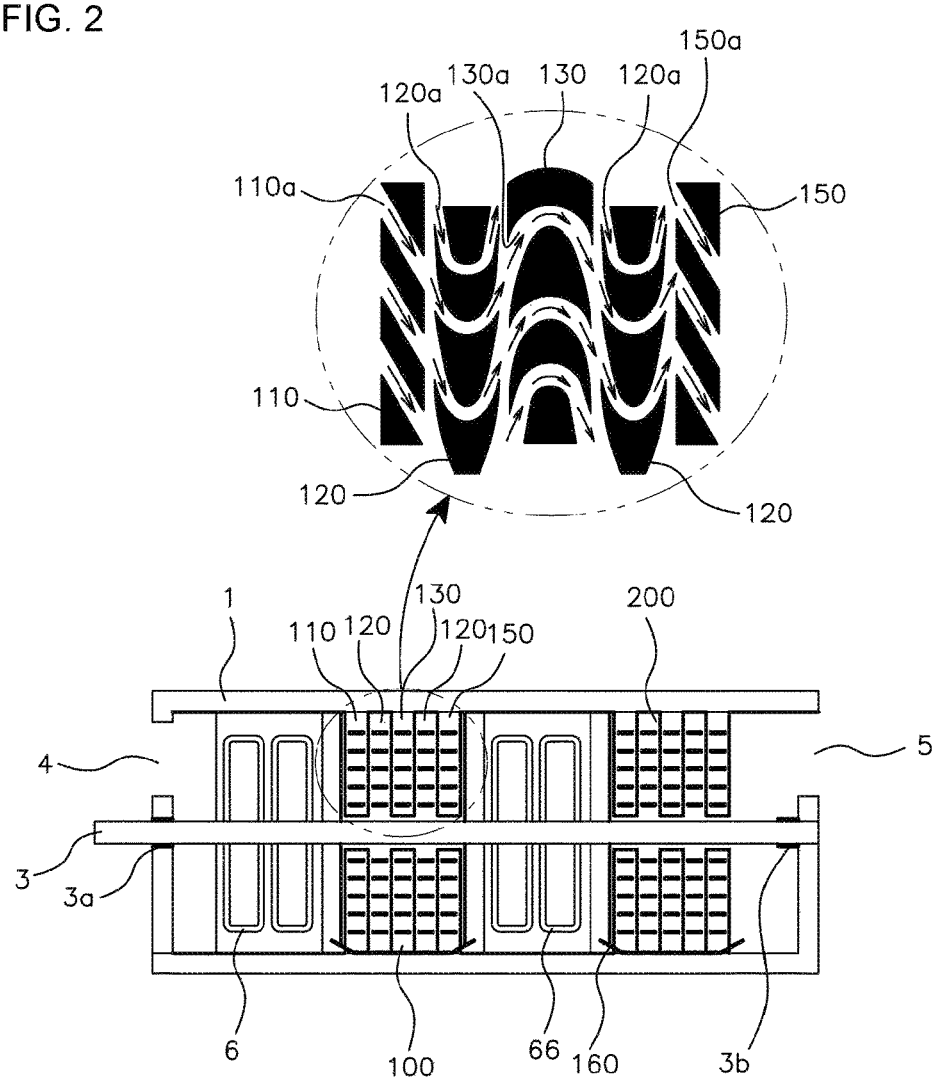
FIG. 2 shows a configuration of an ORC power generation apparatus according to a second embodiment of the present invention, wherein disc turbines for ORC and heat suppliers are provided, and shows an enlarged view of through holes formed on the circumferences of the disc turbines.

As shown in FIG. 2, the rotors 120, which have the shape of a disc, have rotor through holes 120*a* formed with the shape of half-moon from points on concentric circumferences of a front periphery thereof toward the rear periphery thereof in such a manner as to have the same sizes as each other, and the rotors 120 are fitted to the turbine shafts 3 to allow the fluid to pass through the rotor through holes 120*a*, so that they convert the temperature and pressure energy the fluid retains into rotary power.

The inlet plate 110, which has the shape of a disc, has a plurality of fluid introduction through holes 110*a* formed with angles inclined from points on concentric circumferences of a front periphery thereof toward the rear periphery thereof, and the fluid introduction through holes 110*a* have the same inclined angles as inlets of the rotor through holes 120*a* of the rotors 120, into which the fluid flows. As a result, the turbine shaft 3 is fitted to the center of the inlet plate 110, and the inlet plate 110 is fixedly coupled to the inner peripheral wall of the housing 1.

The stator 130, which has a shape of a disc, has stator through holes 130*a* formed with the shape of reverse half-moon from points on concentric circumferences of a front periphery thereof toward the rear periphery thereof in such a manner as to correspond to the rotor through holes 120*a* formed with the shapes of half-moon on the rotors 120 in front of the stator 130 and behind the stator 130, and the sizes and number of the stator through holes 130 are the same as the rotor through holes 120. As a result, the turbine shaft 3 is fitted to the center of the stator 130, and the stator 130 is fixedly coupled to the inner peripheral wall of the housing 1.

The outlet plate 150, which has a shape of a disc, has fluid discharge through holes 150*a* formed from points on concentric circumferences of a front periphery thereof toward the rear periphery thereof in reverse directions to the fluid outlet directions of the rotor through holes 120*a* in such a manner as to have the same sizes and number of the rotor through holes 120*a* formed with the shape of the half-moon on the rotor 120. As a result, the turbine shaft 3 is fitted to the center of the outlet plate 150, and the outlet plate 150 is fixedly coupled to the housing 1.

The rotors 120 come into close contact with one surface of the inlet plate 110 and one surface of the stator 130 and with one surface of the outlet plate 150 and the other surface of the stator 130 in such a manner as to slidingly rotate thereon.

The fluid introduction through holes 110*a* formed on the inlet plate 110 of the power means 100 have the sizes and positions corresponding to the half-moon shaped rotor through holes 120*a* formed on the rotor 120 to allow an appropriate amount of fluid to enter the rotor through holes 120*a* as the fluid paths of the rotor 120, so that a given pressure of fluid can be maintained at the front side of the power means 100 according to the total amount of fluid entering the housing 1. However, the number of fluid introduction through holes 110*a* is smaller than that of rotor through holes 120*a* formed on the rotor 120.

The fluid introduction through holes 110*a* are distributedly formed on the inlet plate 110 at the inclined angles corresponding to the inlets of the rotor through holes 120*a* as the fluid paths of the rotor 120.

The respective through holes as the fluid paths formed on the inlet plate 110, the rotors 120, the stator 130 and the outlet plate 150 of the power means 100 are desirably enlarged in size in accordance with the volume increment of the fluid moving from the inlet plate 110 toward the outlet plate 150, but of course, they may have the same sizes as each other so as to obtain saving in the number of molds to be manufactured and simplification in manufacturing processes.

Moreover, it is necessary that sizes of the through holes formed on the respective parts of the rear side power means 200 are more enlarged than those of the through holes formed on the respective parts of the power means 100, but so as to achieve saving in the manufacturing cost, the rear side power means 200, which is spaced apart from the power means 100 by a given distance with the same shape and size as the power means 100, desirably has the number of fluid introduction through holes (with no reference numeral) of an inlet plate (with no reference numeral) larger than the number of fluid introduction through holes 110*a* of the inlet plate 110 of the front side power means 100.

The ORC power generation apparatus according to the second embodiment of the present invention under the above-mentioned configuration allows the fluid which becomes an intermediate temperature and intermediate and low pressure gas through preheating in a heat source to enter the housing 1 through the fluid inlet 4 by means of the high pressure pump (not shown). Next, the fluid passes through the heat suppliers 6 located in front of the power means 100 and is thus super-heated, and sequentially, the fluid is injected from the fluid introduction through holes 110*a* of the inlet plate 110 and is thus introduced into the rotor through holes 120*a* as the fluid paths of the rotor 120.

The fluid injected from the fluid introduction through holes 110*a* enters the rotor through holes 120*a* of the rotor 120 to generate the rotary power of the rotor 120 through a driving force thereof, and next, the fluid is discharged to the stator through holes 130*a* of the stator 130 bent to the opposite direction to the rotor 120 to generate the rotary power of the rotor 120 through the addition of a reaction force thereof.

The fluid introduced into the stator through holes 130*a* of the stator 130 enters the inlets of the rotor through holes 120*a* of the rotor 120 located behind the stator 130 and bent to the opposite directions to the stator through holes 130*a* through the change in a flowing direction thereof to allow the rotor 120 located behind the stator 130 to rotate to additionally generate the, and next, the fluid is discharged toward the fluid discharge through holes 150*a* of the outlet plate 150 to more additionally generate the power better with the reaction force thereof, so that as the fluid passes through all of the through holes of the parts of the power means 100, the pressure energy thereof can be converted into the rotary power.

While the fluid is passing through the through holes of the power means 100, it is lowered by given amount at temperature and pressure and increased in volume, and in the same manner as the first embodiment of the present invention, the fluid is re-heated, while passing through the rear side heat supplier 66. Further, the pressure of the fluid is somewhat raised, and most of expansion force the fluid retains is consumed, while passing through the rear side power means 100, so that the volume of the fluid is increased and the temperature thereof is lowered. Next, the fluid is discharged to the outside through the fluid outlet 5, enters a liquefier separately provided, and is thus liquefied through heat exchange.

In the same manner as the heat suppliers 6 and 66 in the first embodiment of the present invention, the heat suppliers 6 and 66 in the second embodiment of the present invention are configured to have bands fastenable to an inner peripheral wall of the housing 1 and pipes having the shapes of circular coils located inside the bands, through which the fluid passes.

In the same manner as the fluid in the first embodiment of the present invention, further, the fluid in the second embodiment of the present invention, which flows into the housing 1, moves along the interior of the housing 1 and passes through the heat suppliers 6 and the turbines 2. In this case, the fluid does not flow along a separate fluid pipe located inside the housing 1 so as to perform heat exchange with the heat suppliers 6 through the fluid pipe. According to the present invention, in detail, the fluid moves along the housing 1 and comes into direct contact with the heat suppliers 6 to thus perform heat exchange with the heat suppliers 6, so that all surfaces of the heat suppliers 6 come into direct contact with the fluid, thereby achieving rapid heat exchange and avoiding a pressure loss which is generated when the fluid flows along the fluid pipe.

In the second embodiment of the present invention, as the fluid moves from the front surface of the power means 100 to the rear surface thereof, the power means 100 converts most of heat and pressure energy of the fluid into power, without any unnecessary loss, thereby obtaining the power with high efficiency, and in the same manner as in the first embodiment of the present invention, the second embodiment of the present invention is configured to allow the heat suppliers 6 to be located in front of the inlet plate 110 of the power means 100. In this case, the combined bodies of the heat suppliers 6 and the power means 100 are arranged in series to each other to allow the new renewable energy with a low temperature to be converted into rotary power energy with high efficiency.

Third Embodiment

Figure 3:
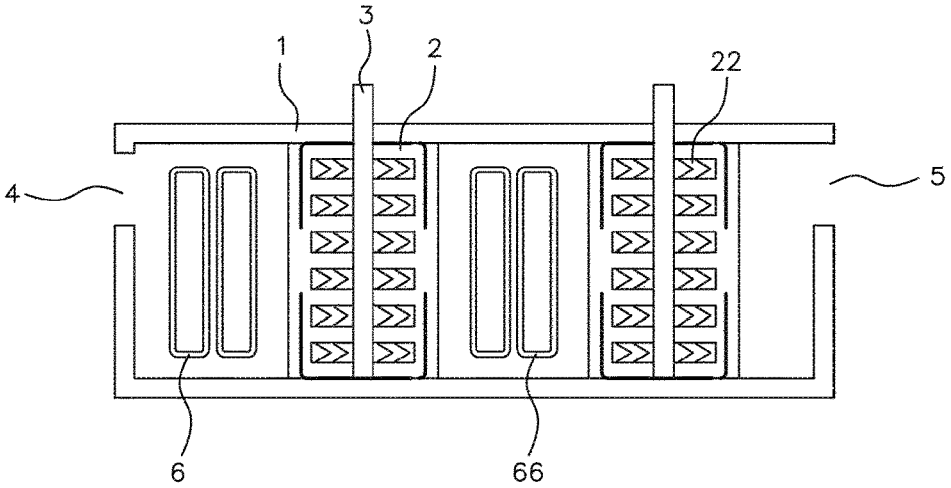
FIG. 3 shows a configuration of an ORC power generation apparatus according to a third embodiment of the present invention, wherein parallel connected turbines for ORC and heat suppliers are provided.

As shown in FIG. 3, an ORC power generation apparatus according to a third embodiment of the present invention is configured to have turbines 2 adopted in the first embodiment of the present invention in such a manner as to have working fluid inlet holes formed on one side surface thereof and working fluid outlet holes formed on the other side surface thereof.

The ORC power generation apparatus includes a housing 1 provided as an insulated and sealed structure and having a front cover with a fluid inlet 4 formed thereon and a rear cover with a fluid outlet 5 formed thereon.

Desirably, the housing 1 whose internal cross-section has the shape of a rectangular parallelepiped.

A front portion of each turbine shaft 3 inside the housing 1 passes through a bored hole formed on the side periphery of the housing 1 in such a manner as to protrude outward, and the working fluid is introduced into one side surface of each turbine 2 and is then discharged to the other side surface of each turbine 2, thereby generating power from the turbines 2. In this case, the plurality of turbines 2 and 22 are located parallel to each other.

The power generated from the outwardly protruding front portions of the turbine shafts 3 from the housing 1 is collected to one point by means of power transfer media like gears, and a load is applied to the collected one point, thereby performing power generation.

Desirably, a high pressure pump (not shown) is fitted to the fluid inlet 4 to put the fluid into the housing 1.

Heat suppliers 6 and 66, which serve as superheaters and a re-heater for the fluid, are located on one side surface of the turbines 2 and 22 located parallel to each other inside the housing 1, that is, on one side surface of the turbines 2 and 22, on which the working fluid inlet holes are formed.

As the heat suppliers 6 serving as the superheaters are located in front of the working fluid inlet hole of the turbine 2 inside the housing 1, like this, the pre-heated fluid flowing into the housing 1 is super-heated, while passing through the heat suppliers 6 inside the housing 1, without any heat loss during the movement of the super-heated at the outside of the housing 1 to the turbine, and is then injected into the turbine 2, thereby generating power with high efficiency. Next, the fluid passing through the turbine 2 is re-heated by the rear side heat supplier 66 and is thus raised in temperature and pressure. After that, the fluid is injected into the rear side turbine 22, thereby additionally generating the power.

In the same manner as the heat suppliers 6 and 66 used as the superheaters and re-heater in the first and second embodiments of the present invention, the heat suppliers 6 and 66 in the third embodiment of the present invention are configured to have rectangular bands fastenable to inner walls of the housing 1 and heat exchanging pipes located inside the bands, through which the fluid passes.

In the same manner as the fluids in the first and second embodiments of the present invention, further, the fluid in the third embodiment of the present invention, which flows inside the housing 1, moves along the interior of the housing 1 and passes through the heat suppliers 6 and the turbine 2, and in this case, the fluid does not flow along a separate fluid pipe located inside the housing 1 so as to perform heat exchange with the heat suppliers 6 through the fluid pipe. According to the present invention, in detail, the fluid moves along the housing 1 and comes into direct contact with the heat suppliers 6 to thus perform heat exchange with the heat suppliers 6, so that all surfaces of the heat suppliers 6 come into direct contact with the fluid, thereby achieving rapid heat exchange and avoiding a pressure loss which is generated when the fluid flows along the fluid pipe.

The ORC power generation apparatus according to the third embodiment of the present invention has similar effects to the ORC power generation apparatuses according to the first and second embodiments of the present invention, but the ORC power generation apparatus according to the third embodiment of the present invention is changed in configuration in accordance with the structures of the turbines 2 provided.

Fourth Embodiment

In addition to the parts of the ORC power generation apparatuses according to the first, second and third embodiments of the present invention, an ORC power generation apparatus according to a fourth embodiment of the present invention includes a fluid liquefier 10 located inside the housing 1. In this case, the ORC power generation apparatus according to the fourth embodiment of the present invention may be configured to have one turbine 2 and one heat supplier 6, and accordingly, an explanation on the ORC power generation apparatus according to the fourth embodiment of the present invention wherein one or more turbines 2 and one or more heat suppliers 6 are provided will be given. Further, the turbines 2 provided in the fourth embodiment of the present invention may be the same as those in the first, second and third embodiments of the present invention, and a detailed explanation on them will be avoided. Hereinafter, the ORC power generation apparatus according to the fourth embodiment of the present invention will be explained with reference to FIG. 4.

A fluid evaporator 11 and a refrigerant evaporator 12 as mentioned in the fourth embodiment of the present invention and in a fifth embodiment of the present invention as will be discussed later are coupled to expansion valves, and accordingly, an explanation on their coupling will be avoided later.

In the fourth embodiment of the present invention, the housing 1 adopted in the first, second and third embodiments of the present invention is configured to allow the fluid outlet 5 formed on the rear cover thereof to be closed and to also allow the inner rear surface thereto to be extended, and the fluid liquefier 10 having the fluid evaporator 11 and the refrigerant evaporator 12 is located inside the extended portion of the housing 1.

Even though the fluid liquefier 10 has any one of the fluid evaporator 11 and the refrigerant evaporator 12, it serves well, but more desirably, the two kinds of evaporators are provided in the fluid liquefier 10, which improves fluid liquefaction efficiency.

A blower fan 8 is located in front of the fluid liquefier 10 so as to transfer the fluid which finishes the power generation to the fluid liquefier 10.

Like the first and second embodiments of the present invention, the turbine shafts 3 are connected in series to each other and the turbines 2 and the heat suppliers 6 are coupled to each other. In the fourth embodiment of the present invention, further, a frame 7 is located in a space between the rear side turbine and the blower fan 8, and a bearing 3*b* is provided at the center of the frame 7, instead of the bearing 4*b* at the center of the rear cover of the housing 1, so that the turbine shafts 3 are fitted to the bearing 3*b* and the bearing 3*a* fitted to the bored hole formed at the center of the front cover of the housing 1, while allowing one side end portion thereof to protrude outward.

If the turbines 2 and 22 are connected parallel to each other like the third embodiment of the present invention, of course, the frame 7 and the bearings 3*a* and 3*b* are not provided.

Further, a fluid tank 9 is located under the fluid liquefier 10, that is, on one side of the bottom of the housing 1, to collect the liquefied fluid thereinto, and the fluid tank 9 is provided with a transfer pump (not shown).

Figure 4:
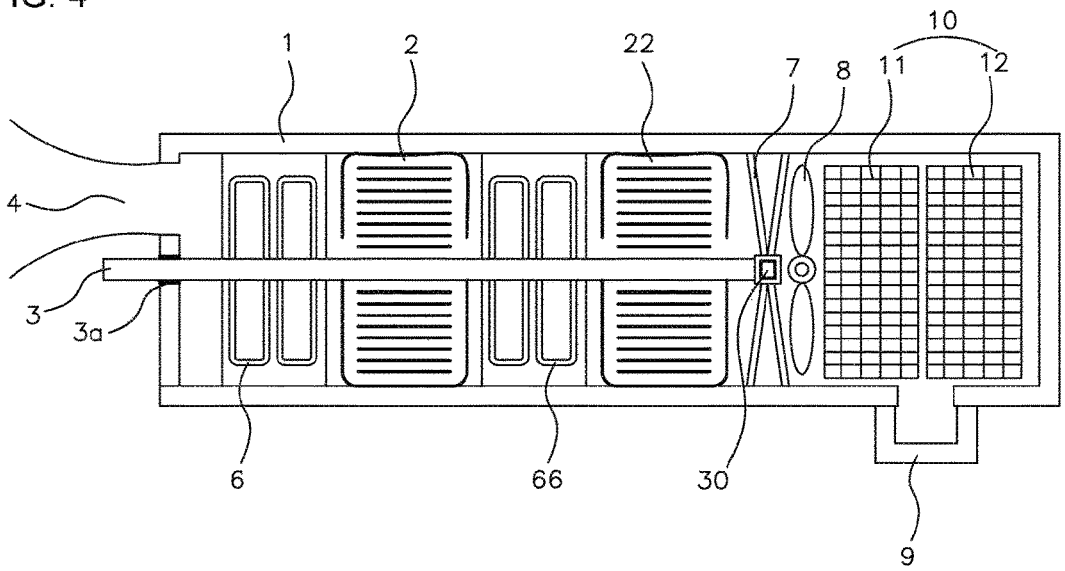
FIG. 4 shows a configuration of an ORC power generation apparatus according to a fourth embodiment of the present invention, wherein parallel connected turbines for ORC, heat suppliers and a fluid liquefier are provided integrally with one another.
Figure 7:
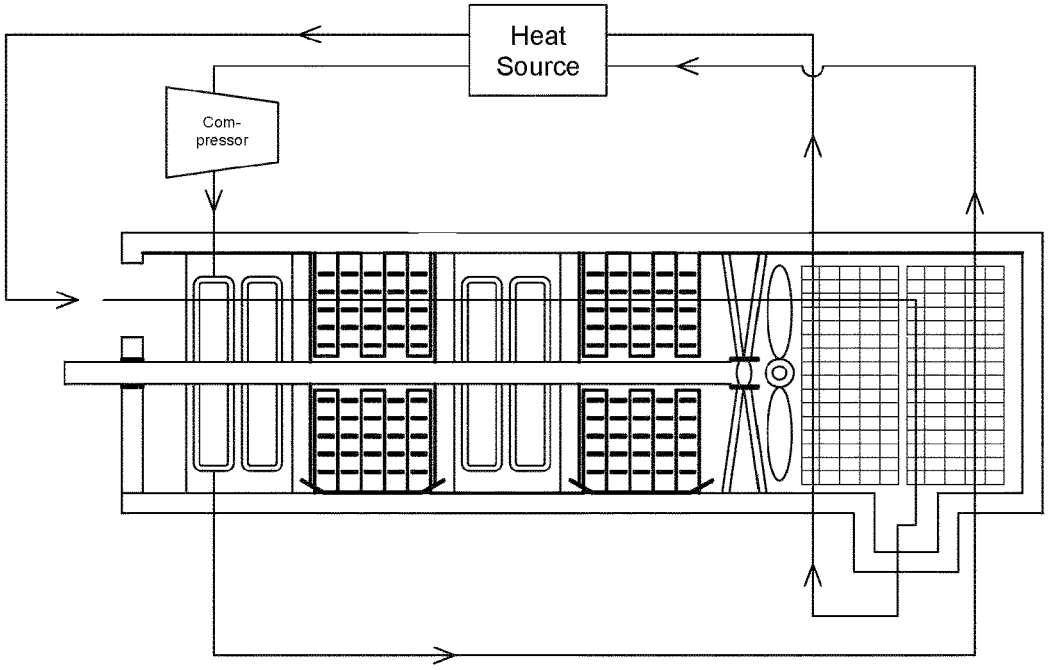
FIG. 7 shows a configuration of an ORC power generation apparatus wherein the disc turbines for ORC according to the second embodiment of the present invention, heat suppliers, and a fluid liquefier are provided integrally with one another, a closed cycle circuit of a working fluid, and a closed cycle circuit of a refrigerant of a refrigeration device.

Now, an explanation on the ORC power generation apparatus according to the fourth embodiment of the present invention will be given with reference to FIGS. 4 and 7. First, if a compressor of a refrigeration device on a closed cycle circuit additionally provided on one side of the outside of the housing 1 is driven with separately applied power, refrigeration gas circulating an interior of the refrigeration device becomes high temperature and high pressure gas and is then liquefied to a low temperature via the heat suppliers 6 inside the housing 1. Next, the gas is moved and thus gasified to the refrigerant evaporator 12 of the fluid liquefier 10, and after that, the gas is moved as external heat source to collect thermal energy and is then circulated to the compressor.

On the other hand, the fluid, which is primarily pre-heated and gasified in the heat source at the outside of the housing 1, is introduced into the housing 1 through the fluid inlet 4 by means of a high pressure pump (not shown), comes into contact with the heat suppliers 6 to perform heat exchange, and becomes high temperature and high pressure gas with a temperature of about 80 to 90° C. Next, the gas passes through the turbines 2 to rotate the turbine shafts 3, thereby generating power.

The fluid, which is lowered in temperature and pressure by the power generated from the rotation of the turbines 2, comes into contact with the rear side heat supplier 66 to perform heat exchange with the heat transfer fluid circulating an interior of the rear side heat supplier 66, and becomes intermediate temperature and intermediate pressure gas whose temperature and pressure are somewhat raised. Next, the gas passes through the rear side turbine 22 to rotate the turbine shafts 3, thereby additionally generating the power.

The fluid, which repeats pressure recovery and power generation, while passing through the rear side heat supplier 66 and the rear side turbine 22, becomes low temperature and low pressure gas and then comes into contact with the fluid evaporator 11 of the fluid liquefier 10 through the blower fan 8. Next, the fluid becomes gasified at the fluid evaporator 11 serving as a cascade condenser and transfers residual thermal energy to the fluid first circulating the ORC circuit, and most of the fluid is liquefied and collected to the fluid tank 9.

A portion of fluid supersaturated, which are not liquefied even through the contact with the fluid evaporator 11, comes into contact with the refrigerant evaporator 12 to which the liquefied refrigerant is moved and gasified from the heat supplier 6 and are thus liquefied and collected to the fluid tank 9 located under the fluid liquefier 10. After that, the fluid is moved to the fluid evaporator 11 through a circulation pump (not shown) and is thus gasified by means of the expansion valve (not shown) provided.

Like this, the fluid gasified in the fluid evaporator 11 is transferred to the external heat source via a pipe, is pre-heated through the heat exchange with the new renewable energy provided, and is thus circulated into the fluid inlet 4 of the housing 1 to generate power, which are repeatedly carried out.

The refrigerant gasified in the refrigerant evaporator 12 desirably makes use of an organic material having a lower gasification temperature than the fluid.

In the fourth embodiment of the present invention, moreover, if the entire size of the housing 1 in which the heat suppliers 6, the turbines 2, and the fluid liquefier 10 are located is greater than a size of a space in which the housing 1 is installed, a portion of the housing 1, in which the fluid liquefier 10 and the blower fan 8 are built, is separatedly spaced apart from the rest of the housing 1 in such a manner as to be connected to the rest of the housing 1 by means of a connection pipe (not shown). In this case, desirably, a minimal cross-sectional area of the connection pipe (not shown) connecting the separated housing 1 to the rest of the housing 1 is greater than 10% of a minimal cross-sectional area of the internal space of the housing 1.

Like this, even if the housing 1 in which the turbines 2 and 22 and the heat suppliers 6 and 66 are located and the housing 1 in which the fluid liquefier 10 is located are built on the places spaced apart from each other, the fluid passing through all of the turbines 2 and 22 passes through the connection pipe (not shown) whose internal cross-sectional area is ensured sufficiently to the given size, thereby minimizing a resistance force which may be caused by bottleneck. As a result, the ORC power generation apparatus, in which the housing 1 for building the turbines 2 and 22 and the heat suppliers 6 and 66 therein and the housing 1 for building the fluid liquefier 10 therein are located on the places spaced apart from each other, has the similar effects to that in which the fluid liquefier 10, the turbines 2 and 22, and the heat suppliers 6 and 66 are combinedly located inside one housing 1.

Desirably, connection flanges are provided on the cut surfaces of the separated housing 1 and on the edge periphery of the connection pipe to easily separate and couple the separated housing 1 and the connection pipe from and to each other. By the way, the connection pipe has to be sealed from external air, but it may be selectively insulated.

Starting power for driving the compressor (with no reference numeral), the high pressure pump (not shown), and the transfer pump (not shown) is first used with external power, but after the ORC power generation apparatus has been driven, desirably, the starting power is used with the self power of the apparatus.

In the ORC power generation apparatus according to the fourth embodiment of the present invention wherein power is generated through the new renewable energy, most of processes of the ORC circuit can be carried out one-stop in the single housing 1, thereby converting the produced new renewable energy into the power energy with high efficiency, allowing the ORC power generation apparatus to be easily built by a person who has a relatively poor skill in installation, and reducing production and maintenance costs.

In the first to fourth embodiments of the present invention, on the other hand, condensed thermal energy of a refrigerant condenser of a refrigeration device operating with the independent closed cycle circuit separately provided can be supplied to the heat suppliers 6 and 66.

In the first to fourth embodiments of the present invention, further, when the fluid is circulated along the heat suppliers 6 and 66 and the external heat source to transfer heat, the external heat source is used as a new renewable energy heat source, and accordingly, the new renewable energy can be supplied to the heat suppliers 6 and 66.

Fifth Embodiment

Figure 5:
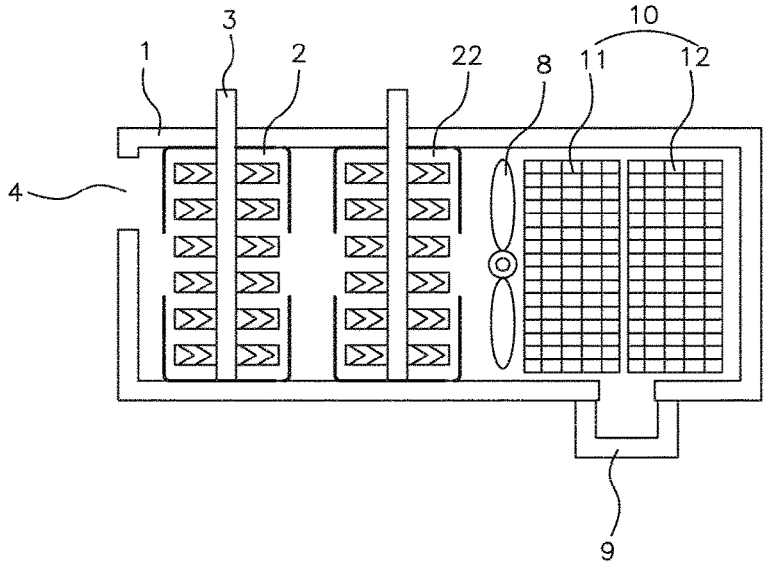
FIG. 5 shows a configuration of an ORC power generation apparatus according to a fifth embodiment of the present invention, wherein parallel connected ORC turbines and a fluid liquefier are provided integrally with one another.

An ORC power generation apparatus according to a fifth embodiment of the present invention, as a modification of the ORC power generation apparatus according to the fourth embodiment of the present invention, is configured to allow a high density heat source supplying new renewable energy to be located in front of the fluid inlet 4 of the housing 1, so that it is not necessary to locate the heat suppliers 6 inside the housing 1, together with the turbines 2. Accordingly, the ORC power generation apparatus according to the fifth embodiment of the present invention can be needed for factories where relatively high temperature waste thermal energy is produced, like steel mills, thermal power plants, and so on. As shown in FIG. 5, the ORC power generation apparatus according to the fifth embodiment of the present invention is configured to have one or more turbines 2 and 22, a fluid liquefier 10, a fluid tank 9, and a blower fan 8 combinedly located inside the housing 1.

The ORC power generation apparatus according to the fifth embodiment of the present invention is built inside the factory in which high temperature waste heat is generated, like a steel mill, a thermal power plant, and so on, thereby reducing an installation area and manufacturing cost and expecting high power generation efficiency.

In the same manner as the fourth embodiment of the present invention, if the entire size of the housing 1 in which the turbines 2 and the fluid liquefier 10 are located is greater than an installation space provided, a portion of the housing 1, in which the fluid liquefier 10 and the blower fan 8 are built, is separatedly spaced apart from the rest of the housing 1 in such a manner as to be connected to the rest of the housing 1 by means of a connection pipe (not shown). In this case, desirably, a minimal cross-sectional area of the connection pipe (not shown) connecting the separated housing 1 to the rest of the housing 1 is greater than 10% of a minimal cross-sectional area of the internal space of the housing 1.

The invention claimed is:

1. An ORC power generation apparatus using new renewable thermal energy to generate power therefrom, comprising:

a housing provided as an insulating structure sealed from external air and having a front cover with a fluid inlet formed thereon and a rear cover with a fluid outlet formed thereon;

a plurality of turbines using an organic compound as a working fluid and having a turbine shaft, the turbine shaft having one end portion passing through a bored hole and a bearing provided on the center of the front cover of the housing in such a manner as to protrude outward and the other end portion coupled to a bearing provided on the center of the rear cover of the housing; and heat suppliers located in front of a working fluid inlet hole formed on each turbine inside the housing, wherein each turbine comprises:

a disc-shaped inlet plate fixedly coupled to an inner peripheral wall of the housing in such a manner as to allow the turbine shaft to pass through the center thereof and having a plurality of fluid introduction through holes formed with angles inclined from the front sides of concentric circumferences thereof toward the rear sides thereof;

a disc-shaped stator fixedly coupled to the inner peripheral wall of the housing in such a manner as to allow the turbine shaft to pass through the center thereof and having a plurality of stator through holes formed to the shape of reverse half-moon with angles inclined from the front sides of the concentric circumferences thereof toward the rear sides thereof;

disc-shaped rotors rotatingly fitted to the turbine shaft and having a plurality of rotor through holes formed to the shape of reverse half-moon with angles inclined from the front sides of the concentric circumferences thereof toward the rear sides thereof, the rotor through holes having inlets formed with the same inclined angle as the fluid introduction through holes of the inlet plate and outlets of the stator through holes and outlets formed with the same inclined angle as inlets of the stator through holes;

a disc-shaped outlet plate fixedly coupled to the inner peripheral wall of the housing in such a manner as to allow the turbine shaft to pass through the center thereof and having a plurality of fluid discharge through holes formed with angles inclined from the front sides of concentric circumferences thereof toward the rear sides thereof in reverse directions to the outlet directions of the rotor through holes of the rotors; and a lubricating oil supplier located on the undersides of the inlet plate, the rotors, the stator, and the outlet plate to allow the rotors to smoothly slide and rotate, wherein the plurality of turbines are connected in series to each other inside the housing, and the heat suppliers are located in front of the inlet plate of each turbine inside the housing such that the working fluid flowing into the housing through the fluid inlet comes into direct contact with the heat suppliers to perform heat exchange and is then supplied to the turbines to increase power generation efficiency.

2. The ORC power generation apparatus according to claim 1, wherein the heat suppliers comprise a refrigerant condenser of a refrigeration device operating with an independent and separately provided closed cycle circuit so that condensation thermal energy of the refrigeration device is supplied to the heat suppliers.

3. The ORC power generation apparatus according to claim 1, wherein the new renewable thermal energy is supplied to the heat suppliers through a heat transfer fluid circulating the heat suppliers and an outside new renewable thermal energy heat source.

4. An ORC power generation apparatus using new renewable thermal energy to generate power therefrom, comprising:

a housing provided as an insulating structure sealed from external air and having a front cover with a fluid inlet formed thereon and a rear cover;

a frame transversely located diagonally on one side peripheral surface of an inner intermediate portion of the housing and having a bearing provided on the center thereof;

a plurality of turbines using an organic compound as a working fluid and having a turbine shaft, the turbine shaft having one end portion passing through a bored hole and a bearing provided on the center of the front cover of the housing in such a manner as to protrude outward and the other end portion coupled to the bearing provided on the center of the frame;

heat suppliers located in front of a working fluid inlet hole formed on each turbine inside the housing;

a fluid liquefier located behind the frame to liquefy the working fluid which finishes power generation after passing through the turbines;

a blower fan located between the frame and the fluid liquefier to allow the working fluid to continuously come into contact with the fluid liquefier; and a fluid tank located under the fluid liquefier, together with a transfer pump, to collect the liquefied working fluid thereinto, wherein the plurality of turbines are connected in series to each other, and the heat suppliers are provided in front of the working fluid inlet hole of each turbine such that the working fluid flowing into the housing through the fluid inlet comes into direct contact with the heat suppliers to perform heat exchange and is then supplied to the turbines to increase power generation efficiency, and the working fluid is liquefied in the housing to provide compact installation, wherein the heat suppliers comprise a refrigerant condenser of a refrigeration device operating with an independent and separately provided closed cycle circuit so that condensation thermal energy of the refrigeration device is supplied to the heat suppliers.

5. The ORC power generation apparatus according to claim 4, wherein each turbine comprises:

a disc-shaped inlet plate fixedly coupled to an inner peripheral wall of the housing in such a manner as to allow the turbine shaft to pass through the center thereof and having a plurality of fluid introduction through holes formed with angles inclined from the front sides of concentric circumferences thereof toward the rear sides thereof;

a disc-shaped stator fixedly coupled to the inner peripheral wall of the housing in such a manner as to allow the turbine shaft to pass through the center thereof and having a plurality of stator through holes formed to the shape of reverse half-moon with angles inclined from the front sides of the concentric circumferences thereof toward the rear sides thereof;

disc-shaped rotors rotatingly fitted to the turbine shaft and having a plurality of rotor through holes formed to the shape of reverse half-moon with angles inclined from the front sides of the concentric circumferences thereof toward the rear sides thereof, the rotor through holes having inlets formed with the same inclined angle as the fluid introduction through holes of the inlet plate and outlets of the stator through holes, and outlets formed with the same inclined angle as inlets of the stator through holes;

a disc-shaped outlet plate fixedly coupled to the inner peripheral wall of the housing in such a manner as to allow the turbine shaft to pass through the center thereof and having a plurality of fluid discharge through holes formed with angles inclined from the front sides of concentric circumferences thereof toward the rear sides thereof in reverse directions to the outlet directions of the rotor through holes of the rotors; and a lubricating oil supplier located on the undersides of the inlet plate, the rotors, the stator, and the outlet plate to allow the rotors to smoothly slide and rotate, wherein the heat suppliers are provided in front of the inlet plate of each turbine such that the working fluid flowing into the housing through the fluid inlet comes into direct contact with the heat suppliers to perform heat exchange and is then supplied to the turbines to increase power generation efficiency, and the working fluid is liquefied in the housing to provide compact installation.

6. The ORC power generation apparatus according to claim 4, wherein the housing is separated into a housing portion for building the turbines and the heat suppliers therein and a housing portion for building the fluid liquefier and the blower fan therein, and the housing further comprises a connection pipe adapted to connect the separated housing portions to each other.

7. The ORC power generation apparatus according to claim 6, wherein the connection pipe has a minimal cross-sectional area greater than 10% of a minimal cross-sectional area of an internal space of the housing.

8. The ORC power generation apparatus according to claim 4, wherein the fluid liquefier comprises a working fluid evaporator as a cascade condenser.

9. The ORC power generation apparatus according to claim 4, wherein the fluid liquefier comprises a refrigerant evaporator of a refrigeration device operating with an independent closed cycle circuit separately provided.

10. An ORC power generation apparatus using new renewable thermal energy to generate power therefrom, comprising:

a housing provided as an insulating structure sealed from external air and having a front cover with a fluid inlet formed thereon and a rear cover;

a plurality of turbines located in parallel to each other inside the housing in such a manner as to use an organic compound as a working fluid and having turbine shafts, each turbine shaft having a front portion passing through a bored hole formed on a side peripheral surface of the housing in such a manner as to protrude outward, and each turbine having a working fluid inlet hole formed on one side peripheral surface thereof;

one or more heat suppliers located in front of the working fluid inlet hole of each turbine inside the housing;

a fluid liquefier located behind a fluid outlet hole formed on the turbines to liquefy the working fluid which finishes power generation after passing through the turbines;

a blower fan located between the turbines and the fluid liquefier to allow the working fluid to continuously come into contact with the fluid liquefier; and a fluid tank located under the fluid liquefier, together with a transfer pump, to collect the liquefied working fluid thereinto, wherein the heat suppliers are provided inside the housing such that the working fluid flowing into the housing through the fluid inlet comes into direct contact with the heat suppliers to perform heat exchange and is then supplied to the turbines to increase power generation efficiency, and the working fluid is liquefied in the housing to provide compact installation.

11. The ORC power generation apparatus according to claim 10, wherein the housing is separated into a housing portion for building the turbines and the heat suppliers therein and a housing portion for building the fluid liquefier and the blower fan therein, and the housing further comprises a connection pipe adapted to connect the separated housing portions to each other.

12. The ORC power generation apparatus according to claim 10, wherein the heat suppliers comprise a refrigerant condenser of a refrigeration device operating with an independent and separately provided closed cycle circuit so that condensation thermal energy of the refrigeration device is supplied to the heat suppliers.

13. The ORC power generation apparatus according to claim 10, wherein the new renewable thermal energy is supplied to the heat suppliers through a heat transfer fluid circulating the heat suppliers and an outside new renewable thermal energy heat source.

14. The ORC power generation apparatus according to claim 10, wherein the fluid liquefier comprises a working fluid evaporator as a cascade condenser.

15. The ORC power generation apparatus according to claim 10, wherein the fluid liquefier comprises a refrigerant evaporator of a refrigeration device operating with an independent closed cycle circuit separately provided.

* * * * *